US006981937B2

(12) United States Patent
Dufrene

(10) Patent No.: US 6,981,937 B2
(45) Date of Patent: Jan. 3, 2006

(54) HANDLE FOR MOUNTING ON PACKAGING, DEVICE FOR MOUNTING THE HANDLE AND METHOD OF MOUNTING HANDLES ON PACKAGING

(76) Inventor: Alain Dufrene, Chemin du Canadel, F-84570 Mormoiron (FR)

( * ) Notice: Subject to any disclaimer, the term of this patent is extended or adjusted under 35 U.S.C. 154(b) by 30 days.

(21) Appl. No.: 10/257,986

(22) PCT Filed: Jan. 30, 2002

(86) PCT No.: PCT/FR02/00352

§ 371 (c)(1),
(2), (4) Date: Oct. 30, 2002

(87) PCT Pub. No.: WO02/060679

PCT Pub. Date: Aug. 8, 2002

(65) Prior Publication Data

US 2003/0145431 A1 Aug. 7, 2003

(30) Foreign Application Priority Data

Jan. 31, 2001 (FR) ..... 01 01282

(51) Int. Cl.
*B31B 1/86* (2006.01)

(52) U.S. Cl. ..... 493/226; 493/909; 493/926

(58) Field of Classification Search ..... 493/84, 493/88, 221, 226, 909, 926; 72/176, 457; 53/134.1; 229/117.24
See application file for complete search history.

(56) References Cited

U.S. PATENT DOCUMENTS 2,379,087 A * 6/1945 Katz ..... 227/21
2,601,816 A * 7/1952 Arneson ..... 493/88
3,034,409 A * 5/1962 Finke et al. ..... 493/335
3,373,476 A * 3/1968 Lombardo et al. ..... 29/774
3,412,651 A * 11/1968 Thibault ..... 493/88
3,423,092 A * 1/1969 Kandel ..... 273/378
3,753,824 A * 8/1973 Bosse ..... 156/227
4,176,423 A * 12/1979 Wigemark ..... 16/406
4,290,254 A * 9/1981 Brunone ..... 53/413
4,558,581 A * 12/1985 Goulstone et al. ..... 72/176
5,095,683 A * 3/1992 Roberts et al. ..... 53/413
5,222,931 A * 6/1993 Roberts et al. ..... 493/88
5,437,594 A * 8/1995 Mattson et al. ..... 493/88
6,014,850 A 1/2000 LeMire

FOREIGN PATENT DOCUMENTS

AU 8748682 A 8/1982
FR 2619551 2/1989

OTHER PUBLICATIONS

Australian Patent Abstract of AU 8748682A.

* cited by examiner

*Primary Examiner*—Stephen F. Gerrity
*Assistant Examiner*—Paul Durand
(74) *Attorney, Agent, or Firm*—Greenblum & Bernstein, P.L.C.

(57) ABSTRACT

Device and method for mounting ends of a handle into slits of a package. The device includes guide rails which guide and orient the ends of the handle from a first position to a second position, wherein, in the second position, the ends of the handle are oriented in a direction that is perpendicular to the slits of the package. The method includes moving the handle towards the guide rails, guiding the handle with the guide rails until the handle assumes the second position, and inserting the ends of the handle into the slits of the package. This abstract is neither intended to define the invention disclosed in this specification nor intended to limit the scope of the invention in any way.

36 Claims, 2 Drawing Sheets

HANDLE FOR MOUNTING ON PACKAGING, DEVICE FOR MOUNTING THE HANDLE AND METHOD OF MOUNTING HANDLES ON PACKAGING

CROSS-REFERENCE TO RELATED APPLICATIONS

The present application is a National Stage Application of International Application No. PCT/FR02/00352, filed Jan. 30, 2002. Further, the present application claims priority under 35 U.S.C. § 119 of French Patent Application No. 01 01282 filed on Jan. 31, 2001.

BACKGROUND OF THE INVENTION

1. Field of the Invention

The present invention relates to a handle mounted on a package, as well as the tool adapted for its mounting.

It relates to the industrial and commercial manufacture and distribution of accessories for packages.

2. Discussion of Background Information

It is common to equip packages made of cardboard or the like with molded or injected plastic handles.

These handles generally have a body or central portion shaped like a strap, provided at each end with a gripping tab that confers to each end of this handle a "T" or "V" shaped profile, and adapted to be engaged, from the outside, into a slit provided for this purpose in the wall of the package, each tab being folded or tilted against the body of the handle prior to its engagement in the slit for which it is adapted.

In order to allow the user to grip the handle and to slip his hand between the handle and the wall of the package, the distance separating the slits provided in the wall of the package for passing and securing the gripping tabs is less than the length of the body of the handle that, as a result, must be partially bent before engaging the tabs in the slits. It is noted that this maneuver is difficult to achieve automatically.

There have been attempts at automating the positioning of individually manufactured handles, whose cost of production is very low, but the machines designed for this end are complex, expensive, slow and not very reliable.

The Patent No. FR 2 619 551 filed by the Applicant of the present invention describes a handle of the aforementioned type adapted to be automatically mounted, the body of the handle being bent during manufacture such that its ends are separated one from the other by a distance equal to the distance separating the slits provided in the wall of the package for which it is adapted. The gripping tabs are flat, and the handle is obtained in a way that each of these tabs forms a sharp angle with the corresponding end of the body, so as to be parallel to the gripping tab located at the other end.

In order to facilitate the automatic mounting of the handles, the latter are manufactured in strips, each of which are constituted of a plurality of handles assembled side by side by bridges made of easily cut material. This arrangement has the advantage of substantially facilitating the feeding of the mounting machines.

Nevertheless, these handles have a certain number of drawbacks:

- the shaping mold is expensive and allows for only slow production rates, thereby generating a high production cost with respect to individual handles;

- the shape of the handle limits the winding possibilities and the number of handles per roll is often found to be insufficient (separate machines);
- the mid-point distance between the axes of the positioning holes on the package is related to the shape of the handle, which imposes minimum dimensions for the package that is to receive the handle; and
- the pushing devices or positioning fingers are limited to simply pushing the handle, without ensuring at all that it holds, which can lead to some positioning issues.

SUMMARY OF THE INVENTION

The device according to the present invention aims to overcome these drawbacks. Indeed, it allows one to obtain handles with the usual shape that approximate economical handles, the mounting of which can be automatically ensured by a simple and reliable positioning machine.

It is constituted by associating continuous strips of flat handles achieved in such a way as to leave, between each of them and the handles adjacent to them, bridges that are easily cut when mounted on a package, and adjustable guide rails arranged to ensure both the bringing together and the orientation of the ends of the handle, such that said ends are positioned directly perpendicularly to the slits of the package adapted to receive them, while causing the body of the handle to bend.

The invention also provides for a device for mounting ends of a handle into slits of a package, the device comprising guide rails which guide and orient the ends of the handle from a first position to a second position, wherein, in the second position, the ends of the handle are oriented in a direction that is perpendicular to the slits of the package.

The guide rails may cause the handle to bend. The package may be made of cardboard. The device may be an automatic machine. The handle may be arranged as a continuous strip of handles. Each handle may be connected to the continuous strip of handles via bridges which are severed when the handle is separated from the continuous strip of handles. The guide rails may be at least one of movably and adjustably mounted. In the first position, the ends of the handle may be oriented in the same direction as the handle, whereby the handle and the ends are in a straight configuration. Each end of the handle may comprise a bulge that is adapted to slide in the guide rails. The guide rails may comprise a groove and each end of the handle may comprise a bulge that is adapted to slide in the grooves of the guide rails. Each guide rail may comprise a longitudinal groove for guiding the ends of the handle. The longitudinal groove may comprise a necking adapted to prevent the end of the handle from escaping during movement of the handle. Each end of the handle may comprise a bulge that is adapted to slide in the longitudinal grooves.

The guide rails may guide and orient the ends of the handle as the handle is movably guided by the guide rails. The guide rails may guide and orient the ends of the handle as the handle is movably guided by the guide rails, whereby the handle enters the guide rails while oriented in the first position and exits the guide rails while oriented in the second position. A distance between guide rails at a guide rail entrance may be greater that a distance between the guide rails at a guide rail exit. The guide rails may be mounted in non-parallel configuration. Each guide rail may be mounted about a pivot axis. Each guide rail may be adjustably mounted about the corresponding pivot axis. Each guide rail may be adjustably mounted to accommodate different handles. Each guide rail may comprise a helical shape, whereby the guide rails force the ends of the handle to make a quarter turn in order to be in a plane perpendicular to a wall of the package when exiting the guide rails.

The device may further comprise a pushing device arranged to push the handle towards the package. The pushing device may be vertically movable. The pushing device may comprise a head which conforms to a shape of the handle in order to ensure positioning of the handle. The handle may comprise anchoring elements arranged at each end. The pushing device may be adapted to cause the anchoring elements to be engaged in the slits of the package. The pushing device may be adapted to cause the anchoring elements to be completely engaged in the slits of the package. The device may further comprise two pushing devices. The two pushing devices may be activated by a vertical jack and a driving system. The device may further comprise shearing blades arranged just past ends of the guide rails. Each end of the handle may comprise a bulge that is adapted to slide in the guide rails. The shearing blades may be adapted to cut bridges which connect the handle to a continuous strip of handles.

The handle may comprise anchoring elements and a central body, each anchoring element being configured so as to fold back against the central body of the handle when they penetrate into the slits of the package and to spread apart through elasticity in order to maintain the handle in place. The anchoring elements may comprise lugs arranged laterally in a plane of the handle. The anchoring elements may comprise tabs that are tilted with respect to a plane of the handle.

The invention also provides for a device for mounting ends of a handle that is arranged on a continuous strip of handles into slits of a package, wherein the device comprises guide rails which guide and orient the ends of the handle as the handle moves. Each guide rail comprises a groove which engages bulges of the continuous strip of handles. Each groove is adapted to change the orientation of an end of the handle from a first position to a second position. In the second position, the ends of the handle are oriented in a direction that is perpendicular to the first direction.

The invention also provides for a method of mounting ends of a handle into slits of a package using a device that comprises guide rails which guide and orient the ends of the handle from a first position to a second position, wherein the method comprises moving the handle towards the guide rails, guiding the handle with the guide rails until the handle assumes the second position, and inserting the ends of the handle into the slits of the package.

The invention also provides for a continuous strip of handles which can each be mounted into slits of a package using a device that comprises guide rails which guide and orient ends of the handles from a first position to a second position, wherein the continuous strip of handles comprises a plurality of handles each having two ends. Each end of the handles includes a bulge. Each handle being connected to an adjacent handle via bridges which are cut when the handle is separated from the continuous strip of handles. In the second position, the ends of the handle are capable of being oriented in a direction that is perpendicular to the slits of the package.

BRIEF DESCRIPTION OF THE DRAWINGS

The attached drawings are given by way of non-restrictive examples of embodiments of the invention wherein.

DETAILED DESCRIPTION OF THE INVENTION

The invention, as shown in FIGS. 1–9, is constituted of handles 1 comprising a central body 2 shaped like a semi-rigid strap equipped with anchoring elements 3, 4, 4' at each of its ends. The invention also provides for two guide rails 5 adapted to be mounted on the automatic mounting machine to bring the handles above the slits provided in the package in order to allow their attachment.

Before they are mounted, the handles are flat and are presented in the shape of a continuous strip manufactured by molding or extruding plastic, such as polyethylene, polyvinyl chloride or the like.

Figure 1:
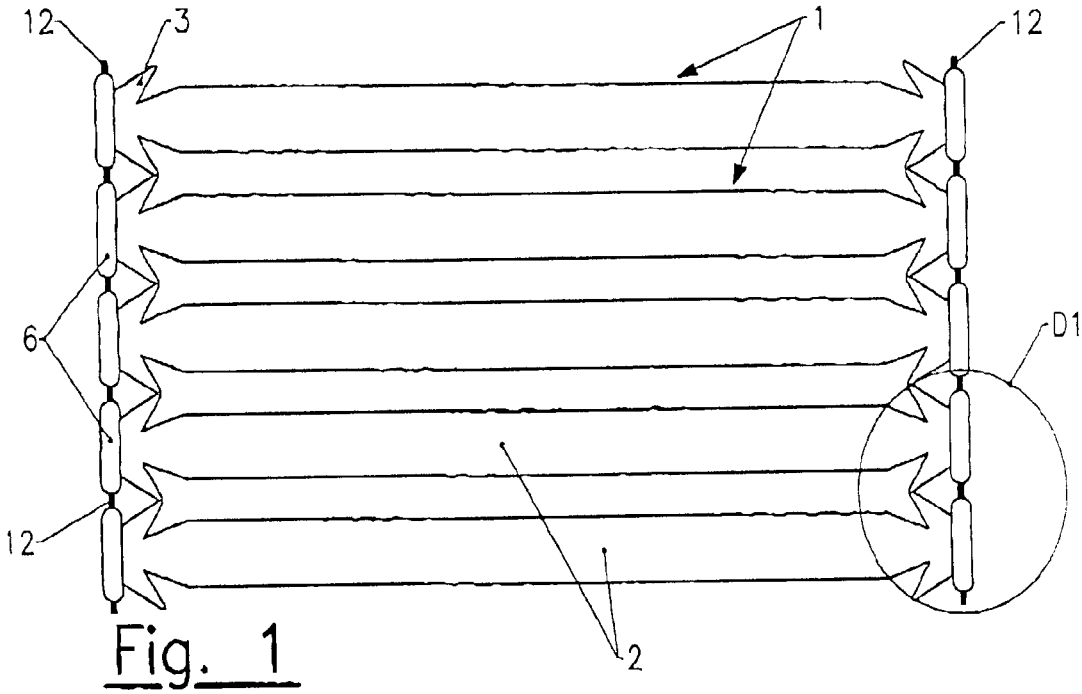
FIG. 1 shows a portion of a strip made of flat handles.
Figure 2:
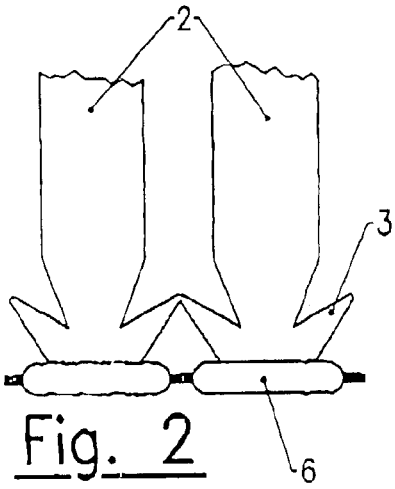
FIG. 2 is a front view of an enlargement of the detail D1 of FIG. 1.
Figure 3:
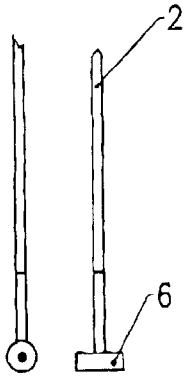
FIG. 3 shows side views of two alternative embodiments of the end of the handle.
Figure 4:
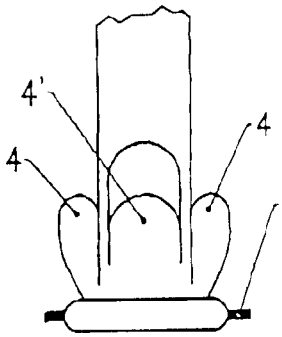
FIGS. 4 and 5 show a different type of end of the handle, under the same conditions as FIGS. 2 and 3.
Figure 5:
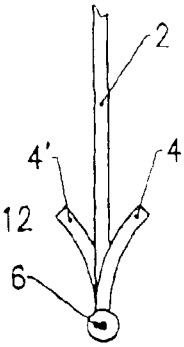
Figure 6:
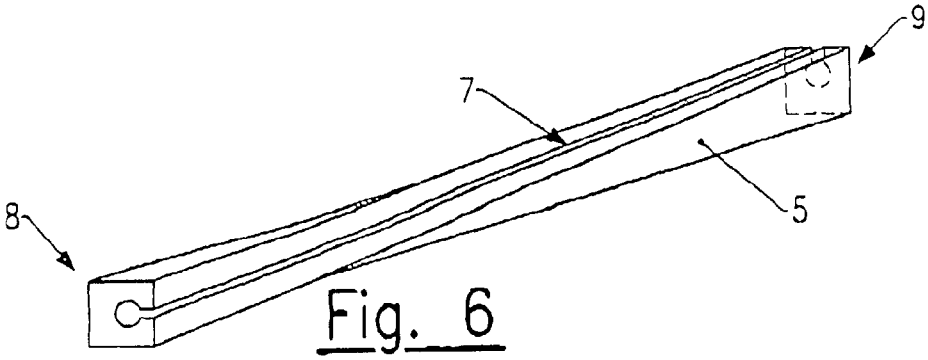
FIG. 6 is an axonometric view of a guide rail.
Figure 7:
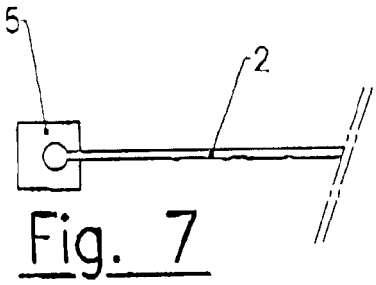
FIG. 7 shows an end view of the entry end of a guide rail with a partial representation of a handle before it is bent.
Figure 8:
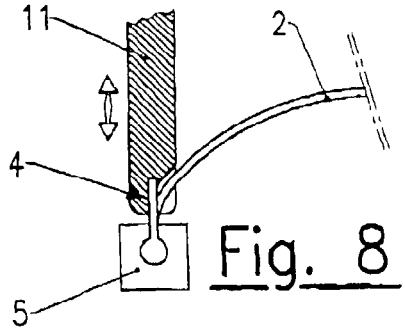
FIG. 8 shows, under the same conditions, the exit end of the guide rail as well as the pushing device for positioning the handles.
Figure 9:
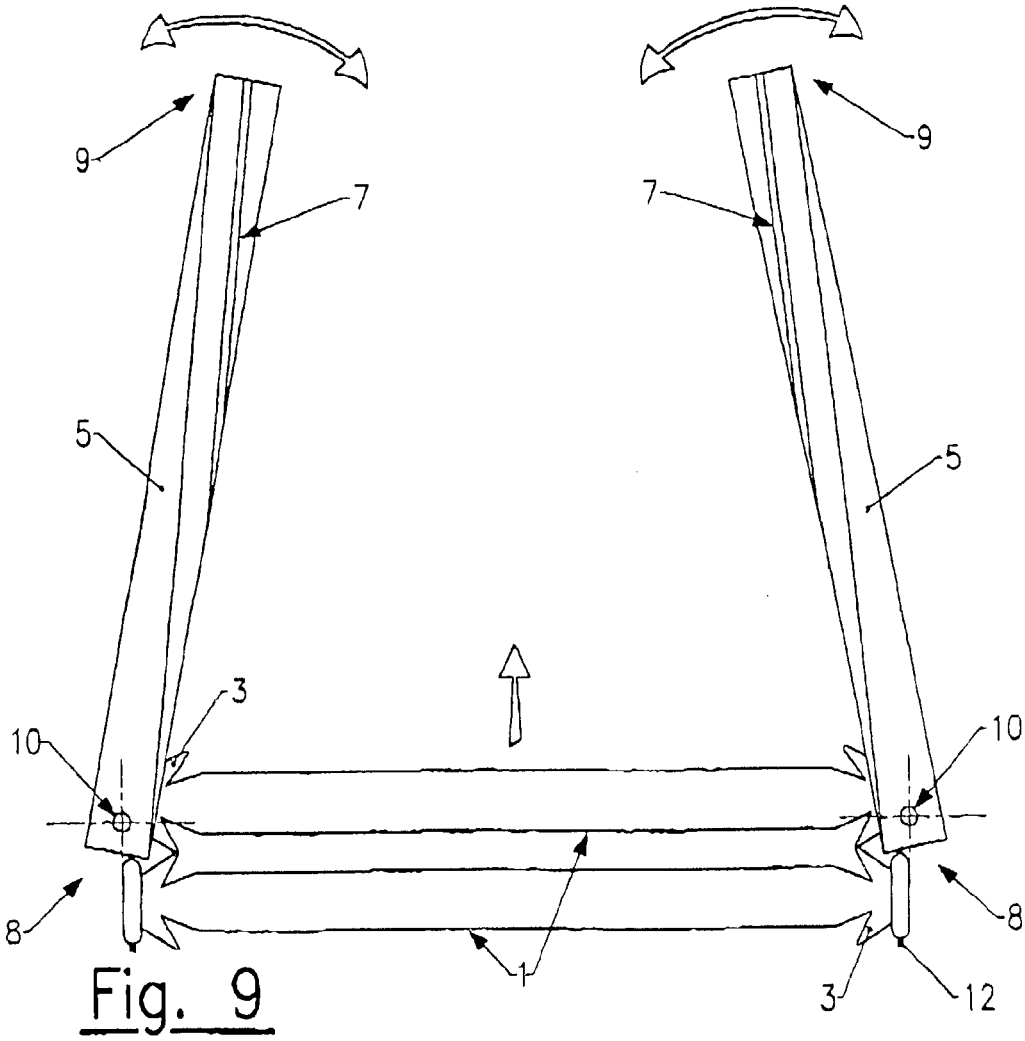
FIG. 9 shows a top view of two guide rails with a handle strip in place.

The anchoring elements can be of two types:

- in a first type, lugs 3 arranged laterally in the plane of the handle (FIGS. 2 and 3), and
- in an second type, tabs 4, 4' that are tilted with respect to the plane of the handle (FIGS. 4 and 5).

The lugs 3 and the tabs 4 are configured so as to be folded back along the central body 2 when they penetrate into the slit of the package and to be spread apart through elasticity in order to maintain the handle in place.

Bulges 6 are provided at the ends of each handle. These bulges 6 are adapted to slide in the guide rails 5.

The guide rails 5 are provided with a longitudinal groove 7 in which the bulges 6 of the handles 1 are engaged. The mid-point between the axes of the rails varies and decreases when going from the entry point 8 to the exit point 9 of the rails, so as to bring the ends of the handle closer together in order for them to be directly perpendicular to the slits of the package, while forcing the handle to bend.

The mid-point between the axes of the exit of the guide rails can be advantageously made adjustable by journaling them about an axis 10 located in the proximity of the entry point 8, which enables the same handles to be used for different packages.

The grooves 7 comprise a necking adapted to prevent the exit of the bulge 6 from escaping during its passage along the length of the rail, and they are helical in shape so as to force the ends of the handles to make a quarter of a turn so that they are in a plane perpendicular to the wall of the package when exiting the guide rail 5.

Each handle 1 that extends past the farther end of the guide rail 5 is then displaced in the direction of the wall of the package, toward the slits of the latter, by two pushing devices 11 having an alternative vertical displacement, the head of which conforms to the shape of the handle in order to ensure its position during the entire positioning phase. These pushing devices cause the anchoring elements 3, 4, 4' to be engaged in the slits until they are completely engaged beyond the wall of the package.

The two pushing devices 11 are advantageously activated by a single vertical jack ensuring both the horizontal advance of the handles by way of levers and a driving system of a known type.

The positioning of the handles 2 on the packages adapted to receive them is substantially improved because the handles 1 are packaged in strips, each of which comprises a plurality of handles connected one to the other by material bridges 12. In this manner, each handle is easily guided by the guide rails 5 of the mounting machine. The system for the positioning of the handles 1 include, in addition to the guide rails 5 and the pushing devices 11, blades located just past the end of the guide rails so that each of the blades acts as a shearing blade for the material bridges 12.

The positioning of the various component elements gives the invention a maximum of useful effects that until now had not been obtained by similar devices.

What is claimed is:

1. A device for mounting ends of a handle into slits of a package, the device comprising:

guide rails comprising longitudinal helical grooves which guide and orient the ends of the handle from a first position to a second position, wherein, in the second position, the ends of the handle are oriented in a direction that is perpendicular to the first position and to the slits of the package, wherein each guide rail is mounted about a pivot axis.

2. The device of claim 1, wherein each guide rail is adjustably mounted about the corresponding pivot axis.

3. The device of claim 1, wherein each guide rail is adjustably mounted to accommodate different handles.

4. A device for mounting ends of a handle into slits of a package, the device comprising:

guide rails which guide and orient the ends of the handle from a first position to a second position; and each guide rail comprising a longitudinal helical groove that receives therein one of the ends of the handle, wherein, in the second position, the handle is bent and the ends of the handle are oriented in a direction that is perpendicular to the first position and to the slits of the package.

5. The device of claim 4, wherein the guide rails cause the handle to bend.

6. The device of claim 4, wherein the package is made of cardboard.

7. The device of claim 4, wherein the device is an automatic machine.

8. The device of claim 4, wherein the handle is arranged as a continuous strip of handles.

9. The device of claim 8, wherein each handle is connected to the continuous strip of handles via bridges which are severed when the handle is separated from the continuous strip of handles.

10. The device of claim 4, wherein the guide rails are at least one of movably and adjustable mounted.

11. The device of claim 4, wherein, in the first position, the ends of the handle are oriented in the same direction as the handle, whereby the handle and the ends are in a straight configuration.

12. The device of claim 4, wherein each end of the handle comprise a bulge that is adapted to slide in the guide rails.

13. The device of claim 4, wherein each end of the handle comprises a bulge that is adapted to slide in one of the helical grooves of the guide rails.

14. The device of claim 4, wherein the guide rails guide and orient the ends of the handle as the handle is movably guided by the guide rails.

15. The device of claim 4, wherein the guide rails guide and orient the ends of the handle as the handle is movably guided by the guide rails, whereby the handle enters the guide rails while oriented in the first position and exits the guide rails while oriented in the second position.

16. The device of claim 4, further comprising a pushing device arranged to push the handle towards the package.

17. The device of claim 16, wherein the pushing device is vertically movable.

18. The device of claim 16, wherein the pushing device comprises a head which conforms to a shape of the handle in order to ensure positioning of the handle.

19. The device of claim 16, wherein the handle comprises anchoring elements arranged at each end.

20. The device of claim 4, further comprising two pushing devices.

21. The device of claim 4, further comprising shearing blades arranged just past ends of the guide rails.

22. The device of claim 21, wherein each end of the handle comprises a bulge that is adapted to slide in the helical grooves of the guide rails.

23. The device of claim 21, wherein the shearing blades are adapted to cut bridges which connect the handle to a continuous strip of handles.

24. The device of claim 4, wherein the handle comprises anchoring elements and a central body, each anchoring element being configured so as to fold back against the central body of the handle when they penetrate into the slits of the package and to spread apart through elasticity in order to maintain the handle in place.

25. The device of claim 24, wherein the anchoring elements comprise lugs arranged laterally in a plane of the handle.

26. The device of claim 24, wherein the anchoring elements comprise tabs that are tilted with respect to a plane of the handle.

27. A device for mounting ends of a handle into slits of a package, the device comprising:

guide rails which guide and orient the ends of the handle from a first position to a second position, wherein, in the second position, the ends of the handle are oriented in a direction that is perpendicular to the first position and to the slits of the package, wherein each guide rail comprises a longitudinal groove for guiding the ends of the handle, and wherein the longitudinal groove comprises a necking adapted to prevent the end of the handle from escaping during movement of the handle.

28. The device of claim 27, wherein each end of the handle comprise a bulge that is adapted to slide in the longitudinal grooves.

29. A device for mounting ends of a handle into slits of a package, the device comprising:

guide rails comprising longitudinal helical grooves which guide and orient the ends of the handle from a first position to a second position, wherein, in the second position, the ends of the handle are oriented in a direction that is perpendicular to the first position and to the slits of the package, wherein a distance between the guide rails at a guide rail entrance is greater that a distance between the guide rails at a guide rail exit.

30. A device for mounting ends of a handle into slits of a package, the device comprising:

guide rails comprising longitudinal helical grooves which guide and orient the ends of the handle from a first position to a second position, wherein, in the second position, the ends of the handle are oriented in a direction that is perpendicular to the first position and to the slits of the package, wherein the guide rails are mounted in a non-parallel configuration.

31. A device for mounting ends of a handle into slits of a package, the device comprising:

guide rails which guide and orient the ends of the handle from a first position to a second position, wherein, in the second position, the ends of the handle are oriented in a direction that is perpendicular to the first position and to the slits of the package, wherein each guide rail comprises a helical shape and a longitudinal helical groove, whereby the guide rails force the ends of the handle to make a quarter turn in order to be in a plane perpendicular to a wall of the package when exiting the guide rails.

32. A device for mounting ends of a handle into slits of a package, the device comprising:

guide rails comprising longitudinal helical grooves which guide and orient the ends of the handle from a first position to a second position; and a pushing device arranged to push the handle towards the package, wherein, in the second position, the ends of the handle are oriented in a direction that is perpendicular to the first position and to the slits of the package, wherein the handle comprises anchoring elements arranged at each end, and wherein the pushing device is adapted to cause the anchoring elements to be engaged in the slits of the package.

33. A device for mounting ends of a handle into slits of a package, the device comprising:

guide rails comprising longitudinal helical grooves which guide and orient the ends of the handle from a first position to a second position; and a pushing device arranged to push the handle towards the package, wherein, in the second position, the ends of the handle are oriented in a direction that is perpendicular to the first position and to the slits of the package, wherein the handle comprises anchoring elements arranged at each end, and wherein the pushing device is adapted to cause the anchoring elements to be completely engaged in the slits of the package.

34. A device for mounting ends of a handle into slits of a package, the device comprising:

guide rails comprising longitudinal helical grooves which guide and orient the ends of the handle from a first position to a second position; and two pushing devices, wherein, in the second position, the ends of the handle are oriented in a direction that is perpendicular to the first position and to the slits of the package, and wherein the two pushing devices are activated by a vertical jack and a driving system.

35. A device for mounting ends of a handle that is arranged on a continuous strip of handles into slits of a package, the device comprising:

guide rails which guide and orient the ends of the handle as the handle moves;

each guide rail comprising a longitudinal helical groove which engages bulges of the continuous strip of handles;

each longitudinal helical groove being adapted to change the orientation of an end of the handle from a first position to a second position, wherein, in the second position, the ends of the handle are oriented in a direction that is perpendicular to the first direction.

36. A method of mounting ends of a handle into slits of a package using a device that comprises guide rails having longitudinal helical grooves which guide and orient the ends of the handle from a first position to a second position, the method comprising:

moving the handle towards the guide rails;

guiding the handle with the guide rails until the handle assumes the second position;

causing, with the longitudinal helical grooves of the guide rails, the ends of the handle to rotate 90 degrees; and inserting the ends of the handle into the slits of the package.

* * * * *